US005542886A

United States Patent [19]

Scott et al.

[11] Patent Number: 5,542,886

[45] Date of Patent: Aug. 6, 1996

[54] PROCESS AND APPARATUS FOR THE PRODUCTION OF STAR PROFILE NAILS

[75] Inventors: George R. Scott, Midlothian; Edwin L. Cutright, Powhatan; Martin W. Heidorn, Chester; William L. Kelly, Midlothian, all of Va.

[73] Assignee: Jewett Automation, Inc., Richmond, Va.

[21] Appl. No.: 280,179

[22] Filed: Jul. 25, 1994

[51] Int. Cl.[6] ..... B21G 3/30

[52] U.S. Cl. ..... 470/34; 470/136

[58] Field of Search ..... 470/36, 40, 136, 470/154, 27, 34, 132

[56] References Cited

U.S. PATENT DOCUMENTS

| | | | |
|---|---|---|---|
| 3,800,348 | 4/1974 | Dunkin | 470/154 |
| 3,964,879 | 6/1976 | Asmus | 29/183.5 |
| 4,755,091 | 7/1988 | Potucek et al. | 411/452 |
| 4,800,746 | 1/1989 | Potucek | 72/372 |
| 4,833,906 | 5/1989 | Potucek | 72/206 |
| 4,858,457 | 8/1989 | Potucek | 72/187 |
| 4,899,515 | 2/1990 | Potucek | 52/738 |
| 4,973,211 | 11/1990 | Potucek | 411/452 |
| 5,081,732 | 1/1992 | Steinhilber | 470/40 |
| 5,140,715 | 8/1992 | Monacelli | 470/40 |

FOREIGN PATENT DOCUMENTS

| | | | |
|---|---|---|---|
| 2034223 | 6/1980 | United Kingdom | 470/40 |

*Primary Examiner*—Lowell A. Larson
*Assistant Examiner*—Thomas C. Schoeffler
*Attorney, Agent, or Firm*—Norman B. Rainer

[57] ABSTRACT

A process for transforming the round shafts of nails into a multi-vaned profile involves supplying an oriented sequence of abuting identical nails to an indexing operation where the nails are separated and uniformly oriented, then feeding the nails head first downwardly into the nip of rolls which secure each nail by its head and form the round shaft of each secured nail into a multi-vaned profile. Apparatus for performing the nail transforming process includes an indexing mechanism, a downward feeding mechanism, and a set of forming rolls positioned to rotate in vertical planes.

10 Claims, 3 Drawing Sheets

PROCESS AND APPARATUS FOR THE PRODUCTION OF STAR PROFILE NAILS

BACKGROUND OF THE INVENTION

1. Field of the Invention

This invention concerns nails having a shank portion whose cross-sectional configuration is multi-vaned for providing greater holding power in wooden substrates.

2. Description of the Prior Art

Nails whose shank portions are of star-shaped cross-sectional profile, characterized in having about five pointed vanes, provide greater holding power when joining wooden members. Such nails further possess greater rigidity, and require less material than nails of circular profile having the same effective shank diameter and length.

Despite their known advantages, practical methods for the fabrication of star-profile nails have been elusive. In one general approach, disclosed by Frank Potucek in his U. S. Pat. Nos.: 4,800,746 and 4,833,906, a continuous length of nail-forming wire stock is fed to a first set of rollers that imparts a polygonal cross-section to the wire, and successively to a second set of rollers which converts the polygonal surfaces to vanes. Repeating sections of the wire remain non-formed or skipped. The wire is then severed at said skipped sections and shaped into the nail head or point.

A serious problem with the Potucek technique is that, every time the wire is severed and a head is formed, the advancing and forming mechanism must be stopped. Since the forming rollers are of considerable size and weight, the high frequency start/stop phenomenon produces an oscillating inertial load of very high force amplitude. Such forces are sufficient to cause rapid wear and malfunction of equipment components.

In efforts to overcome the Potucek start/stop problem, it has been sought to merely sever the Potucek formed wire at the skipped spaces, and subsequently form heads on the severed wire segments. Such action would not necessitate stoppage of the roll-forming operation. However, it has been found to be extremely difficult to grip a short piece of star-profile wire with sufficient force to permit a head to be shaped at one extremity.

It is accordingly an object of the present invention to provide a practical process for the manufacture of star-profile nails.

it is another object of this invention to provide a process as in the foregoing object which is substantially continuous in producing star-profile nails from a coil of wire of circular cross section.

It is a further object of the invention to provide apparatus useful in a nail-forming process of the aforesaid nature.

These and other beneficial objects and advantages will be apparent from the following description.

SUMMARY OF THE INVENTION

The above and other beneficial objects and advantages are accomplished in accordance with the present invention by a process for producing multi-vaned nails comprising:

a) continuously advancing iron wire of uniform circular cross section to a first operation where the wire is severed into equal successive lengths having upstream and downstream extremities, and a head portion is formed at one of said extremities and a point formed at the opposite extremity, thereby producing a nail having a shank portion of circular cross section, b) forwarding said nails to a second operation which orients said nails, and places them in abutting disposition, suspended from their heads on an advancing mechanism, c) receiving onto an indexing mechanism nails from said advancing mechanism, whereby said nails are individually separated in a uniformly oriented disposition, d) feeding said oriented nails sequentially downwardly in a straight line path in head first disposition, e) receiving said downwardly directed nails into the entering nip of interengaged forming rolls having uniformly spaced notches which interact to secure the head of each nail, and further having regions between said notches which form the shank portion into a multi-vaned profile, whereby the heads of the nails enter said notches, and f) discharging said formed nails at the exiting nip of said forming rolls.

In preferred embodiments, said advancing mechanism is a stationary inclined track which permits sliding descent of the suspended nails.

The apparatus of the present invention is comprised of:

a) an indexing mechanism which receives nails from an advancing mechanism, and separately secures said nails in a uniformly oriented disposition, b) a downward feeding mechanism which receives nails from said indexing wheel and directs them downwardly in a straight line path in spaced apart head first sequence, c) a plurality of forming rolls tangentially interengaged at a common nip site, each roll having uniformly spaced notches which meet with equally spaced notches of the other rolls to form chambers which secure the head of each nail, and having regions between said notches which form the shank portion of each secured nail into a multi-vaned profile, there being one forming roll for each vane of said profile, and d) coupling means interactive between said downward feeding mechanism and said forming rolls to ensure that the head of each nail enters a successive chamber of said rolls.

BRIEF DESCRIPTION OF THE DRAWING

For a fuller understanding of the nature and objects of the invention, reference should be made to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
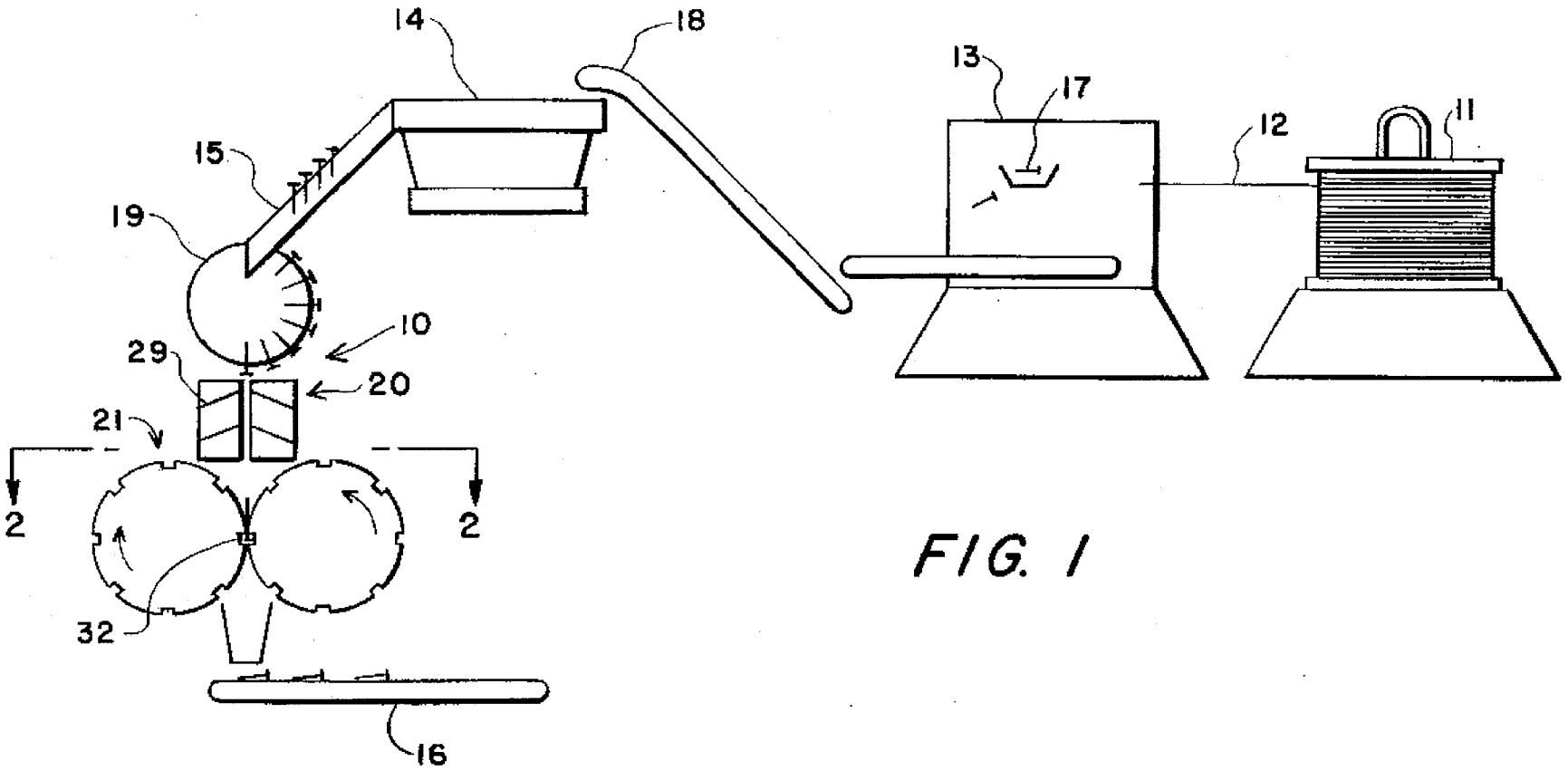
FIG. 1 is a schematic side view of an embodiment of the apparatus of the present invention shown in operative association with nail-manufacturing components of the prior art.

Referring to FIGS. 1–4, an embodiment of the apparatus 10 of this invention is shown in functional association with a coil 11 of nail-forming wire 12, nail forming device 13 of conventional design, a vibratory bowl feeder 14, an advancing mechanism in the form of inclined track 15, and a conveyor belt 16 which receives finished multi-vane nails from apparatus 10.

Nail forming device 13 draws wire 12 from coil 11, severs the wire to pre-determined equal lengths, and forms a head and point upon opposed extremities of each length of severed wire. Such action essentially forms a nail 17 from the starting wire. A suitable embodiment of nail forming device 13 is made and sold by the Enkotec Company of Denmark. An inclined continuous belt conveyor 18 carries the newly formed nails from nail forming device 13 to bowl feeder 14.

Said bowl feeder is a vibrating device which serves the purpose of orienting the nails so that all the head extremities are pointed in the same direction. A suitable embodiment of a vibratory bowl feeder useful in the practice of the present invention is made by the Feeder Technology Company of Rockford, Ill.

Nails emergent from the bowl feeder enter inclined feed track 15 in a manner whereby the nails are suspended from their heads and are in abutment such that the head of one nail is beneath the head of the next adjacent nail. The nails slide downwardly by gravity effect into the apparatus of this invention, comprised of indexing wheel 19, downward feeding mechanism 20, and forming rolls 21.

Figure 3:
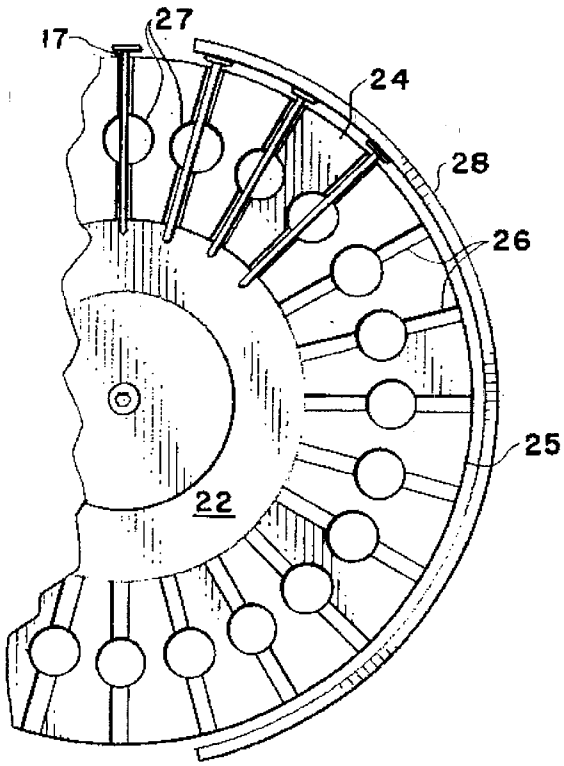
FIG. 3 is an enlarged fragmentary side view of the indexing mechanism of the apparatus of FIG. 1.

Indexing wheel 19, as shown in greater detail in FIG. 3, is disposed for rotation in a vertical plane and is comprised of a receiving face 22 having an upraised annular region 24 contiguous with the circular perimeter 25 of the wheel. A series of equally spaced slots 26 extend radially through region 24. The length and depth of said slots are such as to accommodate the particular size of nails being manufactured by the apparatus. A round aperture 27 is disposed in wheel 12 in association with each slot 26. The purpose of the apertures is to enable a magnetic field, induced by a stationary magnet, not shown, to urge the nails into snug fit within each slot. The nails are entered into slots 26 such that the head portion of the nails extend beyond perimeter 26. The nails enter the slots with their heads upwardly directed, and are carried in 180 degrees of circular path, causing the heads to be downwardly directed. A nail-retaining rail 28 is disposed outwardly from perimeter 25 and parallel thereto, extending for almost all of said 180 degrees of circular path, and terminating just short of the downwardly vertical position.

Nails at the lowermost extremity of travel on wheel 19, namely said downwardly vertical position, are gripped by their heads by a downwardly feeding mechanism, represented by paired feed augers 20. Said augers are of identical circular cylindrical contour, having spiral guide means 29 disposed upon their cylindrical surfaces. The axes of said augers are vertically disposed, and the augers are rotated upon said axes at a controllable speed. In other embodiments, a single auger may be employed with an interactive vertical slide track. Still other, equivalent devices may be employed to achieve the same results.

Figure 2:
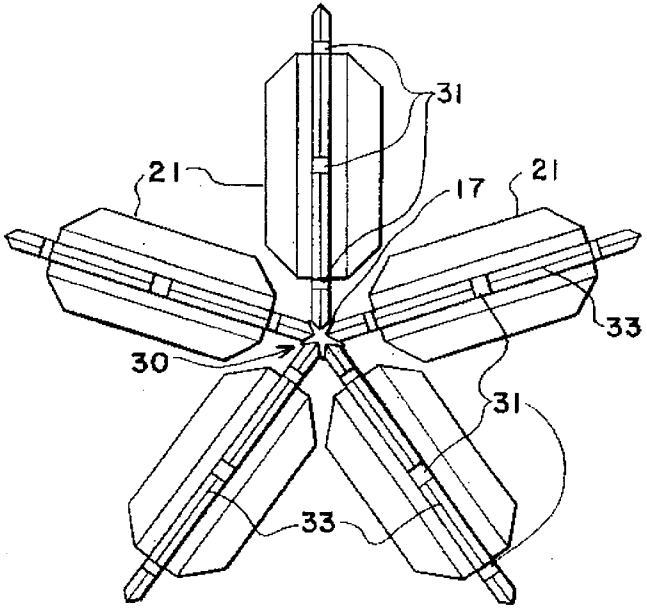
FIG. 2 is a sectional view taken in the direction of the arrows upon the line 2—2 of FIG. 1.
Figure 4:
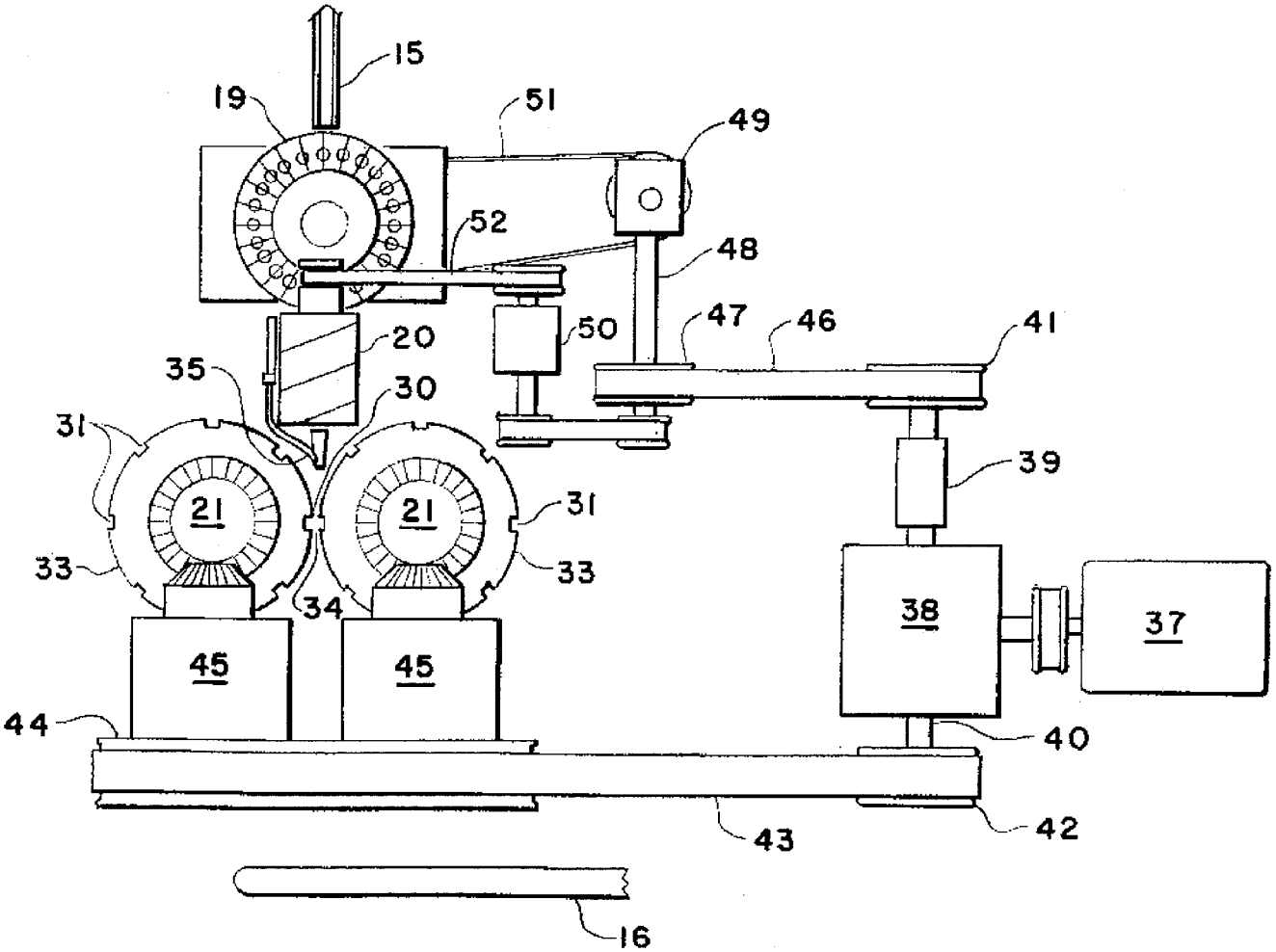
FIG. 4 is an enlarged schematic side view of the apparatus of FIG. 1.

As indicated in FIG. 2, the separated and oriented nails emergent from the bottom of said feed augers enter into the upstream nip, or point of convergence 30 of forming rolls 21. When producing star-profile nails having a five-pointed stap cross-sectional configuration, five rolls are employed. All five rolls are disposed to rotate in vertical planes, said planes being radially disposed about said nip and equidistantly separated in a circular array. The five rolls meet tangentially at-the same upstream nip point 30. Each roll has a circular working perimeter comprised of uniformly spaced notches 31 which meet with equally spaced notches of the other rolls to form chambers 32 which secure the head of each nail. The regions of the perimeters between said notches are V-shaped blades 33 which act upon the nail, transforming the metal of the shank of the nail from the initially circular contour to a multi-vaned contour as shown in FIG. 2. It is important to note that the forming rolls perform by gripping each nail by its head, and pulling it through the upstream nip of the rolls, whereby the forming of the shaft of each nail proceeds from the head toward the point. The Formed nails emerge from forming rolls 21 in the same vertical straight line since leaving the indexing wheel 19, said emergence being from the site of divergence, or downstream nip 34 of said rolls, as shown in FIG. 4. The forming rolls rotate at a controlled speed consistent with the speed of feed augers 20. It is important to note that, whereas the prior art method for fabricating star profile nails, as disclosed in the aforesaid Potucek Patents, requires two separate sets of forming rollers in series, the instant invention employs only one set of forming rolls. In fact, a second set of forming rolls would not readily adapt to the nail-making technique of this invention. The exemplified single set of rolls achieves vane-formation primarily because of a robust and precise construction facilitated by the horizontal arrangement of the rolls which permits mounting upon a floor surface.

The completely formed nails may then be conveyed away to shipping containers, or may be forwarded to specialized metal finishing operations.

In some embodiments of the apparatus, it may be desirable to interpose an escapement device 35 between the lowermost part of the auger rolls and upstream nip 30 of the forming rolls. The purpose of such escapement device is to further assure the accurate registry of the heads of nails with notches 31 in said forming rolls. The escapement may, for example, be a simple spring-loaded feeler arm that will release a nail when the force of a subsequent nail being advanced by the feed augers exceeds the spring-loaded force of the arm.

The entire apparatus can be driven by a single motor 37 interactive with reducing gear box 38. Output shafts 39 and 40, emergent from said gear box, are equipped with sheaves 41 and 42, respectively. Lower belt 43 extends from sheave 42 to engagement with wheel 44 interactive with transmission units 45 that drive wheels 21. Upper belt 46 engages sheave 41 and extends to sheave 47 that drives control shaft 48. Timing control is achieved by a phasing coupling interactive between sheave 41 and the drive input to the augers. Said control shaft, in turn, interacts with right angle gear box 49 and components having numeral designation 50 which represents two bearing housings and belt-driving gears. Components 49 and 50, in turn, control the speed of belts 51 and 52 respectively. By virtue of said drive and synchronizing components, indexing wheel 19, augers 20 and forming rolls 21 operate at compatible speeds, whereby one nail at a time is processed through the system at high speed without jamming. The apparatus is capable of producing 1000 nails per minute.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A process for producing multi-vaned nails comprising:

a) continuously advancing iron wire of uniform circular cross section to a first operation where the wire is severed into equal successive lengths having upstream and downstream extremities, and a head portion is formed at one of said extremities and a point formed at the opposite extremity, thereby producing a nail having a shank portion of circular cross section, b) forwarding said nails to a second operation which orients said nails, and places them in abutting disposition suspended from their heads on an advancing mechanism, c) receiving onto an indexing mechanism nails from said advancing mechanism, whereby said nails are individually separated in a uniformly oriented disposition, d) feeding said oriented nails sequentially downwardly in head first disposition, e) receiving said downwardly directed nails into the entering nip of interengaged forming rolls having uniformly spaced notches which interact to secure the head of each nail, and further having regions between said notches which form the shank portion into a multi-vaned profile, whereby the heads of the nails enter said notches, and f) discharging said formed nails at the exiting nip of said forming rolls.

2. The process of claim 1 wherein said advancing mechanism is a stationary inclined track which permits sliding descent of the suspended nails.

3. The process of claim 1 wherein, in feeding said oriented nails sequentially downwardly in head first disposition, said nails travel in a straight line path.

4. The process of claim 3 wherein said straight line path is substantially vertical.

5. Apparatus for the production of multi-vaned nails comprising:

a) an indexing mechanism which receives a series of downwardly advancing abuting nails and separately secures said nails in a uniformly oriented disposition, b) a downward feeding mechanism which receives nails from said indexing mechanism and directs them downwardly in a straight line path in spaced apart head first sequence, c) a plurality of forming rolls tangentially interengaged at a common nip site, each roll having uniformly spaced notches which meet with equally spaced notches of the other rolls to form chambers which secure the head of each nail, and having regions between said notches which form the shank portion of each secured nail into a multi-vaned profile, there being one forming roll for each vane of said profile, and d) coupling means interactive between said downward feeding mechanism and said forming rolls to ensure that the head of each nail enters a successive chamber of said rolls.

6. The apparatus of claim 5 wherein said indexing mechanism is of circular shape and disposed for rotation in a vertical plane.

7. The apparatus of claim 5 wherein said downward feeding mechanism includes an auger.

8. The apparatus of claim 5 wherein said forming rolls are disposed to rotate in vertical planes.

9. The apparatus of claim 5 wherein said regions between said notches in said forming rolls are V-shaped blades.

10. The apparatus of claim 8 wherein said planes are equidistantly separated in a circular array.

* * * * *